US005842351A

United States Patent [19]

Earhart, Jr.

[11] Patent Number: 5,842,351

[45] Date of Patent: Dec. 1, 1998

[54] MIXING DEVICE FOR IMPROVED DISTRIBUTION OF REFRIGERANT TO EVAPORATOR

[75] Inventor: Walter Earhart, Jr., La Crosse, Wis.

[73] Assignee: American Standard Inc., Piscataway, N.J.

[21] Appl. No.: 957,190

[22] Filed: Oct. 24, 1997

[51] Int. Cl.[6] ..... F25B 5/00

[52] U.S. Cl. ..... 62/117; 62/504; 62/525

[58] Field of Search ..... 62/504, 525, 117; 165/174

[56] References Cited

U.S. PATENT DOCUMENTS

| | | | |
|---|---|---|---|
| 3,745,787 | 7/1973 | Ponziani | 62/504 |
| 4,089,368 | 5/1978 | Bell, Jr. et al. | 165/139 |
| 4,393,661 | 7/1983 | Vakil | 62/113 |
| 4,406,134 | 9/1983 | Vakil | 62/114 |
| 4,524,823 | 6/1985 | Hummel et al. | 165/174 |
| 4,543,802 | 10/1985 | Ingelmann et al. | 62/525 |
| 4,593,539 | 6/1986 | Humpolik et al. | 62/504 |
| 4,702,086 | 10/1987 | Nunn, Sr. et al. | 62/113 |
| 4,866,947 | 9/1989 | Webster | 62/196 |
| 4,922,732 | 5/1990 | Eriksson | 62/525 |
| 5,046,321 | 9/1991 | Webster | 62/116 |
| 5,243,838 | 9/1993 | Ide et al. | 62/527 |
| 5,341,656 | 8/1994 | Rust, Jr. et al. | 62/504 X |
| 5,507,151 | 4/1996 | Ring et al. | 62/115 |

OTHER PUBLICATIONS

Self–Contained Unit Ventilator Heat Pump and Air Conditioning Models; UV–DS–2; Jul. 1997.

Installation, Operation and Maintenance Manual Air Cooled Self–Contained Unit Ventilator Heat Pump and Air Conditioner Models THPB, TACB; TSCB–IOM–1;(Jun. 1997).

*Primary Examiner*—Henry Bennett
*Assistant Examiner*—Susanne C. Tinker
*Attorney, Agent, or Firm*—William J. Beres; William O'Driscoll; Peter D. Ferguson

[57] ABSTRACT

An improved distribution system for an evaporator. The system comprises an evaporator having a plurality of heat exchange flow paths; and an evaporator distributor operably connecting the plurality of flow paths to an evaporator inlet. The system includes an impingement device having an outlet operably connected to the evaporator inlet and having at least a pair of fluid inlets arranged so that fluid entering through either of the fluid inlets directly impinges upon fluid entering the other fluid inlet thereby providing a churned up fluid to the impingement device outlet. Additionally, the system includes an expansion device having an inlet and an outlet; and a separator having a separator inlet connected to the expansion valve outlet and having at least a pair of outlets. The separator is arranged to divide fluid from the expansion device into several streams and direct those streams to its outlets. The system also includes at least a pair of conduits, each having a first end connected to a separator outlet and a second end connected to an impingement device inlet.

20 Claims, 2 Drawing Sheets

40
16
28
42
50
52
54
56
32
34
36
30
48
46
44
58
60
62
64
66
68
70

MIXING DEVICE FOR IMPROVED DISTRIBUTION OF REFRIGERANT TO EVAPORATOR

BACKGROUND OF THE INVENTION

The present invention is directed to an improved mixing device for improving distribution of refrigerant to an evaporator.

More specifically, refrigerant is a two-phase fluid which can stratify between an expansion valve and the distributor of an evaporator when these two devices are spaced apart. In such eventuality, some flow paths from the distributor are all vapor or all liquid while other flow paths are two phase mixtures. The stratification is worsened by any turns in the conduit approaching the distributor since liquid refrigerant is thrown outwardly and vaporous refrigerant is forced inwardly.

The present invention overcomes such stratification problems by separating the refrigerant stream leaving the expansion valve into two streams. The two streams are subsequently reunited by directly impinging those streams upon each other to create turbulence. The turbulence ensures that the refrigerant stream is or becomes homogeneous and thereby avoids the problem of some refrigerant distributor paths getting all liquid, some paths getting all vapor, and some paths getting various mixtures of liquid and vapor.

SUMMARY OF THE INVENTION

The present invention has an object, feature and an advantage to overcome the problems of prior art heat exchangers.

The present invention has an object, feature and an advantage to ensure that refrigerating fluid being distributed to an evaporator is homogenous in nature.

The present invention has an object, feature and an advantage to avoid the use of inserts such as turbulators.

The present invention avoids the stratification problems that can occur when a refrigerant fluid stratifies into liquid phase and vapor phase between an expansion valve and a remotely located evaporator distributor such that uneven distribution of refrigerant to the various portions of the evaporator occurs.

The present invention provides a method of mixing refrigerant being provided to an evaporator comprising the steps of: expanding a refrigerant; splitting the expanded refrigerant into at least two flow paths; impinging the refrigerant in each split flow path into the refrigerant in at least one other split flow path to agitate and churn up the impinged refrigerant; directing the impinged refrigerant to a distributor; and distributing the refrigerant to an evaporator.

The present invention further provides an improved distribution system for an evaporator. The system comprises an evaporator having a plurality of heat exchange flow paths; an evaporator distributor operably connecting the plurality of flow paths to an evaporator inlet; an impingement device having an outlet operably connected to the evaporator inlet and having at least a pair of fluid inlets arranged so that fluid entering through either of the fluid inlets directly impinges upon fluid entering the other fluid inlet thereby providing a churned up fluid to the impingement device outlet. The system also includes an expansion device having an inlet and an outlet; and a separator having a separator inlet connected to the expansion valve outlet and having at least a pair of outlets. The separator is arranged to divide fluid from the expansion device into several streams and direct those streams to its outlets. The system also includes at least a pair of conduits, each having a first end connected to a separator outlet and a second end connected to an impingement device inlet.

The present invention still further provides a mixing arrangement for an evaporator. The mixing arrangement comprises: an evaporator having a distributor and an inlet connected to the distributor and providing a fluid thereto; and a mixing device having an outlet operably connected to the evaporator inlet and having at least two inlets. The inlets are arranged so that fluid flow through one of the inlets will impinge upon fluid flow through another of the inlets.

BRIEF DESCRIPTION OF THE DRAWINGS

FIG. 3 shows alternative embodiments of the mixing device of FIG. 2.

DETAILED DESCRIPTION OF THE INVENTION

Figure 1:
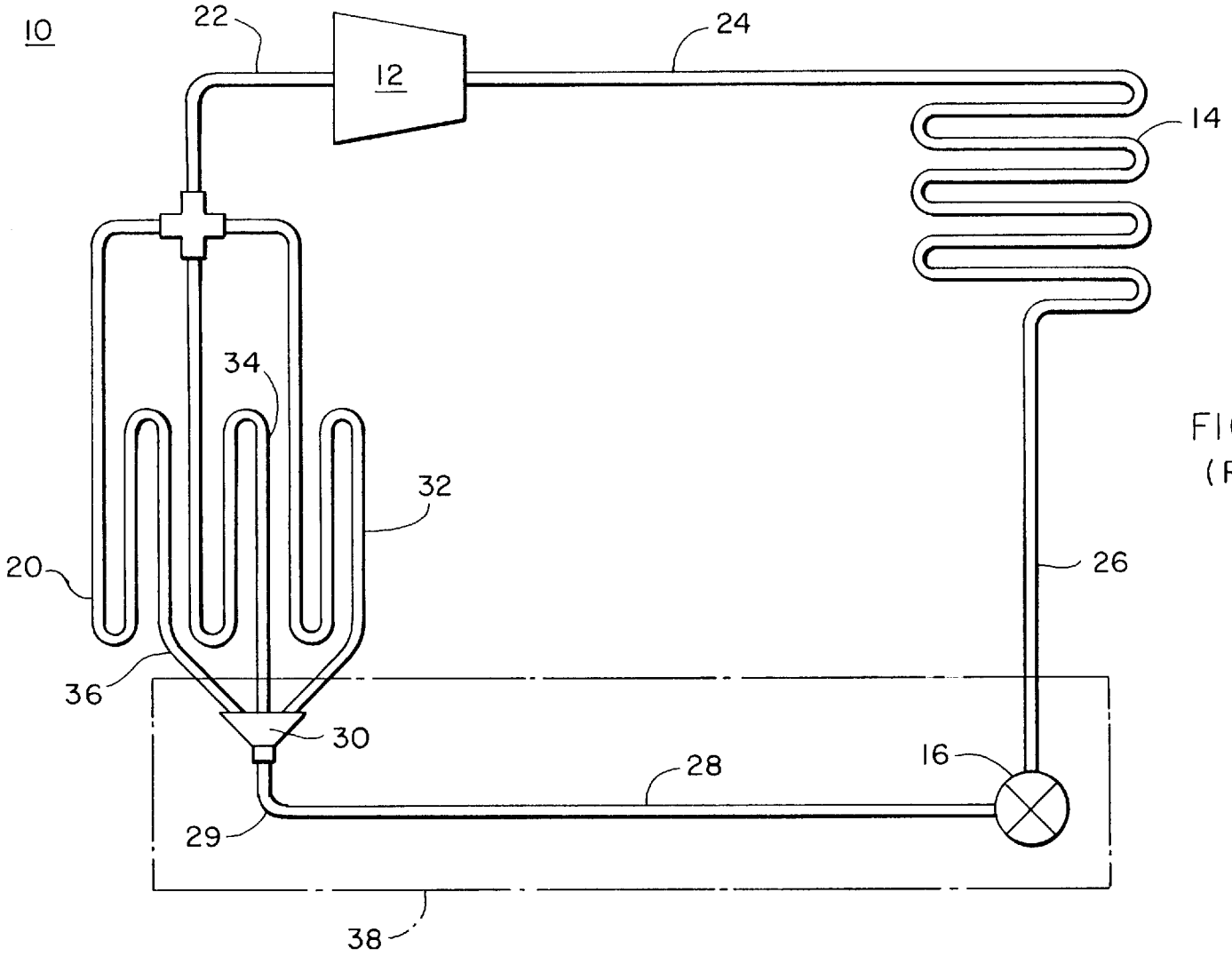
FIG. 1 (PRIOR ART)
FIG. 1 is a conventional refrigeration system including a prior art expansion valve and evaporator distribution arrangement.

FIG. 1 shows an air conditioning or refrigeration system 10 including a compressor 12, a heat exchanger such as a condenser 14, an expansion device such as an expansion valve 16 and a heat exchanger such as an evaporator 20.

The evaporator 20 transfers heat from a fluid to be cooled to a refrigerant inside various refrigerant conduit 20, the refrigerant absorbing the heat and vaporizing in the process. The vaporized refrigerant is directed by tubing 22 to the compressor 12 where the refrigerant is compressed. The compressed refrigerant leaves the compressor 12 by means of tubing 24 and travels to the condenser 14 where the compressed refrigerant is condensed. The condensed refrigerant travels by conduit 26 from the condenser 14 to the expansion valve 16 where the refrigerant is metered by the expansion valve 16 and directed back to the evaporator by conduit 28 to begin the refrigeration process again.

To distribute refrigerant evenly to the evaporator 12, the conduit 28 connects to a distributor 30 which distributes the refrigerant into a number of flow paths 32, 34, 36, each flow path representing a path through the evaporator 12. Although three flow paths 31, 34, 36 are shown in FIG. 1, the number of flow paths varies depending upon the application, the size of the evaporator 20, the type of the evaporator 20 and other characteristics of the system 10.

In prior art systems 10 such as shown in FIG. 1, the refrigerant being metered through the expansion valve 16 has a small portion flash immediately into a vapor leaving a cooler refrigerating fluid, both the flashed vapor and the cooler liquid refrigerant traveling in the tubing 28 to the distributor 30. If the mixture in the tubing 28 stratifies into layers of vapor, two-phase fluid, and liquid, the distributor 30 will not function properly. This may be worsened by a 90° turn 29 which forces the liquid refrigerant to the outside of the turn 29 and the vaporous refrigerant to the inside of the turn 29. When this separated mixture reaches the distributor 30, the outside circuits of the heat exchanger, such as those fed by the path 36, tend to flood while the inside circuits, such as those fed by the path 32, are highly superheated. For example, a primarily liquid layer may be directed down the flow paths 36, a two-phase mixture may be developed and directed down flow path 34, and a primarily vaporous mixture may be developed along flow paths 32. If this occurs, the evaporator 20 does not function properly in transferring heat from the fluid to be cooled.

Figures 2, 3A, 3B, 3C, 3D, 3E, 3F:
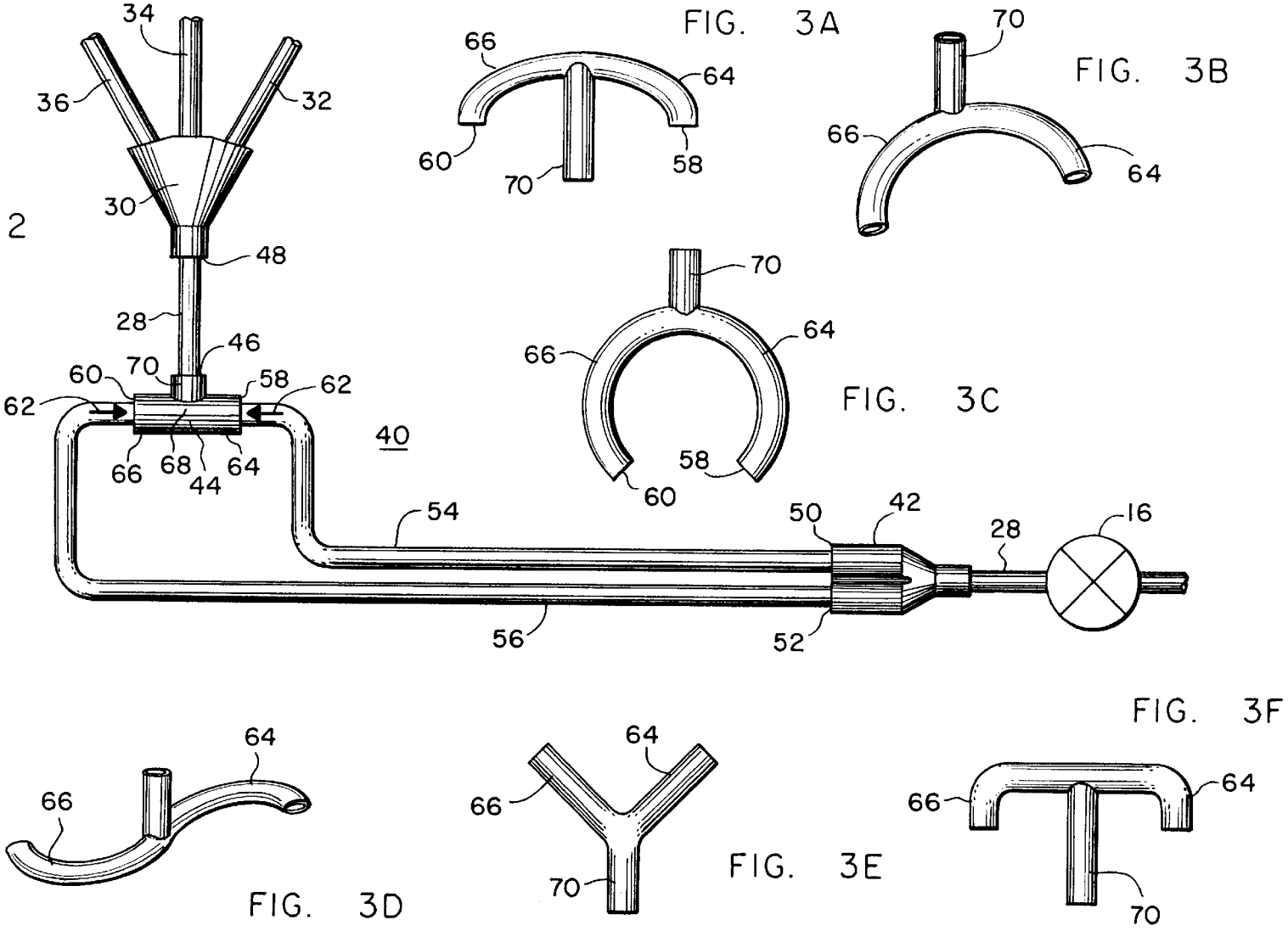
FIG. 2 shows the mixing device of the present invention located between the expansion valve and the evaporator distributor as applied to a system similar to FIG. 1.

FIG. 2 shows a portion of FIG. 1 as indicated by the dashed lines 38 and as modified in accordance with the present invention.

In FIG. 2, the conduit 28 is substantially replaced by the mixing arrangement 40 of the present invention. The mixing arrangement 40 generally includes a tuning fork shaped or Y-shaped separator 42 connected by the conduit 28 to the outlet of the expansion valve 16. The mixing arrangement 40 also includes a generally T-shaped impingement device 44 having an outlet 46 connected by the conduit 28 to the inlet 48 of the distributor 30. The separator 42 divides the refrigerant into two streams and directs those streams out a pair of outlets 50, 52. The outlets 50, 52 are respectively connected by conduit 54, 56 to first and second respective inlets 58, 60 of the impingement device 44.

Arrows 62 indicate that the refrigerant fluid streams entering the inlets 58, 60 of the impingement device 44 directly impinge upon each other to agitate the refrigerant fluids and create turbulence. The turbulent refrigerant mixture becomes homogenous and exits the impingement device 44 by the outlet 46 and directly enters into the distributor 30. The distributed refrigerant in the paths 32, 34, 36 is now also homogenous in nature and the evaporator 12 functions as designed.

The impingement device 44 basically includes an inlet arm 64 connecting the inlet 58 to an impingement area 68 and an inlet arm 66 connecting the inlet 60 to the impingement area 68. Turbulent refrigerant is mixed in the impingement area 68 by direct head on collision, and the turbulent refrigerant exits the impingement area 68 through an outlet arm 70 connecting the impingement area 68 to the outlet 46. Preferably, the impingement device 44 is located in near or direct proximity to the distributor 30.

FIG. 3 shows various alternative embodiments of the impingement device 44.

In FIG. 3A, the arms 64, 66 are curved and form a half circle, and the outlet arm 70 provides exit flow back in the same direction as the inlets 58, 60. Like the preferred embodiment, the arms 64, 66 and 70 of the impingement device 44 of FIG. 3A lie in a common plane.

FIG. 3B shows that the exit arm 70 may be rotated from FIG. 3A in a direction substantially perpendicular to the common plane of the inlet arms 64, 66.

FIG. 3C further illustrates that the inlet arm 70 may be rotated even further to point in a direction away from the inlets 58, 60 and also illustrates that the inlet arms 64, 66 may be extended greater than the half circle arc of FIGS. 3A and 3B. In this arrangement, the arms 64, 66, 70 again lie in a common plane.

FIG. 3D shows that the inlet arms 64, 66 may have the same curvature to form a generally figure S-shape. Here, the inlet arms 64, 66 lie in a common plane but the outlet arm 70 is substantially perpendicular to that common plane.

FIG. 3E shows that the T-shaped impingement device 44 of Figure D may have its inlet arms 64, 66 angled slightly so as to form the Y-shape shown in FIG. 3E. Here, the arms 64,66 and 70 are again in a common plane.

FIG. 3F illustrates that the inlet arms 64, 66 may be of varying sizes including the illustrated example where the size of the inlet arm 64 is greater than the size of the inlet arm 66.

What has been illustrated is a mixing device for improved distribution of refrigerant to an evaporator. It will be apparent to a person of ordinary skill in the art that many modifications and alterations are contemplated. Such modifications and alterations include the application to various heat exchangers other than evaporators, the changing of the shape of the impingement device or the angle or direction of impingement, the various conventional changes to the separation device including to a Y shape or a T shape as well as changes to the tubing in the distributor itself and variations in the expansion valve. Additionally, although the present invention is disclosed in terms of an evaporator, the person of ordinary skill in the art will readily recognize the applicability of the present invention to all heat exchangers having a distributor remotely located from an expansion device. All such modifications and alterations are contemplated to fall within the spirit and scope of the invention as claimed.

What is desired to be secured for Letters Patent of the United States is as follows.

I claim:

1. A method of mixing refrigerant being provided to an evaporator comprising the steps of:

expanding a refrigerant;

splitting the expanded refrigerant into at least two flow paths;

impinging the refrigerant in each split flow path into the refrigerant in at least one other split flow path to agitate and churn up the impinged refrigerant;

directing the impinged refrigerant to a distributor; and distributing the refrigerant to an evaporator.

2. The method of claim 1 including the further steps of:

providing a device to facilitate the impinging; and locating the impingement device proximal the distributor.

3. The method of claim 2 including the further step of:

shaping the impingement device in the shape of a T.

4. The method of claim 3 wherein the impinging step includes the further step of:

causing the impinging flows of refrigerant to meet head on.

5. The method of claim 1 wherein the impinging step includes the further step of:

causing the impinging flows of refrigerant to meet head on.

6. An improved distribution system for an evaporator comprising:

an evaporator having a plurality of heat exchange flow paths;

an evaporator distributor operably connecting the plurality of flow paths to an evaporator inlet;

an impingement device having an outlet operably connected to the evaporator inlet and having at least a pair of fluid inlets arranged so that fluid entering through either of the fluid inlets directly impinges upon fluid entering the other fluid inlet thereby providing a churned up fluid to the impingement device outlet;

an expansion device having an inlet and an outlet;

a separator having a separator inlet connected to the expansion valve outlet and having at least a pair of outlets, the separator being arranged to divide fluid from the expansion device into several streams and direct those streams to its outlets; and at least a pair of conduits, each having a first end connected to a separator outlet and a second end connected to an impingement device inlet.

7. The distribution system of claim 6 wherein the impingement device includes an impingement area respectively linked by first and second arms to one of the pair of fluid inlets and wherein the impingement device includes an outlet arm linking the impingement area to the impingement device outlet.

8. The distribution system of claim 7 wherein the first and second inlet arms and the outlet arm are arranged in a T-shape.

9. The distribution system of claim 7 wherein the first and second inlet arms and the outlet arm are arranged in a Y-shape.

10. The distribution system of claim 7 wherein the first and second arms lie in a common plane.

11. The distribution system of claim 10 wherein the outlet arm is arranged in a direction substantially perpendicular to the common plane.

12. The distribution system of claim 10 wherein the outlet arm is arranged to lie in the common plane.

13. The distribution system of claim 12 wherein the separator is generally arranged in a Y-shape.

14. The distribution system of claim 10 wherein the impingement device is substantially adjacent and connected to the evaporator distributor.

15. The distribution system of claim 6 wherein the impingement device is substantially adjacent and connected to the evaporator distributor.

16. A mixing arrangement for an evaporator comprising:

an evaporator having a distributor and an inlet connected to the distributor and providing a fluid thereto; and a mixing device having an outlet operably connected to the evaporator inlet and having at least two inlets arranged so that fluid flow through one of the inlets will impinge upon fluid flow through another of the inlets.

17. The mixing arrangement of claim 16 wherein the at least two mixing device inlets are in a linear arrangement and the mixing device outlet is substantially perpendicular to the linear arrangement.

18. The mixing arrangement of claim 16 wherein the mixing device is in close proximity to the evaporator inlet.

19. The mixing arrangement of claim 16 wherein the mixing device is T-shaped.

20. The mixing arrangement of claim 16 wherein the mixing device is Y-shaped.

* * * * *